US005657571A

United States Patent [19]

Peterson

[11] Patent Number: 5,657,571

[45] Date of Patent: Aug. 19, 1997

[54] VERTICAL POSITION INDICATOR FOR OPTICAL SIGHTS

[76] Inventor: Charles Eugene Peterson, 443 Ventura #10, Palo Alto, Calif. 94306

[21] Appl. No.: 500,164

[22] Filed: Jul. 10, 1995

[51] Int. Cl.[6] ..... F41G 1/38

[52] U.S. Cl. ..... 42/101; 33/245

[58] Field of Search ..... 42/101, 1.01, 100; 33/245, 246, 247, 248

[56] References Cited

U.S. PATENT DOCUMENTS

| | | | |
|---|---|---|---|
| 2,308,635 | 1/1943 | Walker | 33/241 |
| 3,556,666 | 1/1971 | Lichtenstern | 33/241 |
| 5,005,308 | 4/1991 | Parks | 42/101 |
| 5,223,650 | 6/1993 | Finn | 42/101 |

FOREIGN PATENT DOCUMENTS

| | | | |
|---|---|---|---|
| 313105 | 6/1918 | Germany | 33/245 |
| 3401855 | 7/1985 | Germany | 33/246 |

*Primary Examiner*—Stephen M. Johnson

[57] ABSTRACT

The present invention discloses a vertical position indicator for the correction of roll axis sighting errors in firearms equipped with optical sights.

1 Claim, 1 Drawing Sheet

VERTICAL POSITION INDICATOR FOR OPTICAL SIGHTS

The present invention relates in general to optical sights for firearms, and in particular to means for eliminating sighting errors due to roll axis rotation, or cant.

BACKGROUND OF THE INVENTION

1) Field of the Invention

In typical optical sights for firearms (Burris, U.S. Pat. No. 3,161,716) a principal optical sighting datum, or reticle, comprising a post, dot or crosshair is used to align the bore of the firearm along the longitudinal axis of pitch and the longitudinal axis of yaw with a target for purposes of enabling accurate aimed fire. Such optical sights typically incorporate no means for indicating a longitudinal axial rotation of the firearm.

Optical sights are typically mounted substantially above the plane of the bore of a firearm. The ballistic relationship between this configuration of bore and sight and the gravitational forces acting upon the projectile require that the line bisecting the longitudinal axis of bore and scope be exactly vertical relative to the gravitational forces acting upon the firearm for accurate aimed fire. During sighting, any axial rotation, or cant, of the firearm from this ideal position will induce significant roll axis error (*Precision Shooting*, June, 1991 pp 46–49).

Elimination of sighting errors due to roll axis rotational error in current and conventional practice is a matter of guesswork for the shooter.

2) Description of Prior Art

Benchrest shooters typically build massive, level benches and rest flat-bottomed firearms on plumbed mechanical rests as a means of eliminating roll axis error. Such means are not portable, rendering them ineffective for field or military use. Patent search has revealed proposed electrical and mechanical means for the elimination of cant (Beisner, U.S. Pat. No. 5,315,781; Parks, U.S. Pat. No. 5,005,308; Lichtenstern, U.S. Pat. No. 3,556,666 et. al.). Such means as are disclosed in prior art differ significantly from the present invention, as the following description will make perfectly clear.

OBJECT OF THE INVENTION

It is a principal object of the present invention to provide a practical means for the correction of roll axis sighting errors during field use of firearms equipped with optical sights.

SUMMARY OF THE INVENTION

This object is acheived in the present invention by fixing a co-axial vertical position indicator to an optical sight, in such a way that the indicator can be viewed while the sight is in use.

The features and advantages of the present invention will become apparent from the following detailed description of the preferred embodiment of the invention when read with the accompanying drawing.

BRIEF DESCRIPTION OF THE DRAWING

The sole drawing

DETAILED DESCRIPTION OF PREFERRED EMBODIMENT OF THE INVENTION

Figure 1:
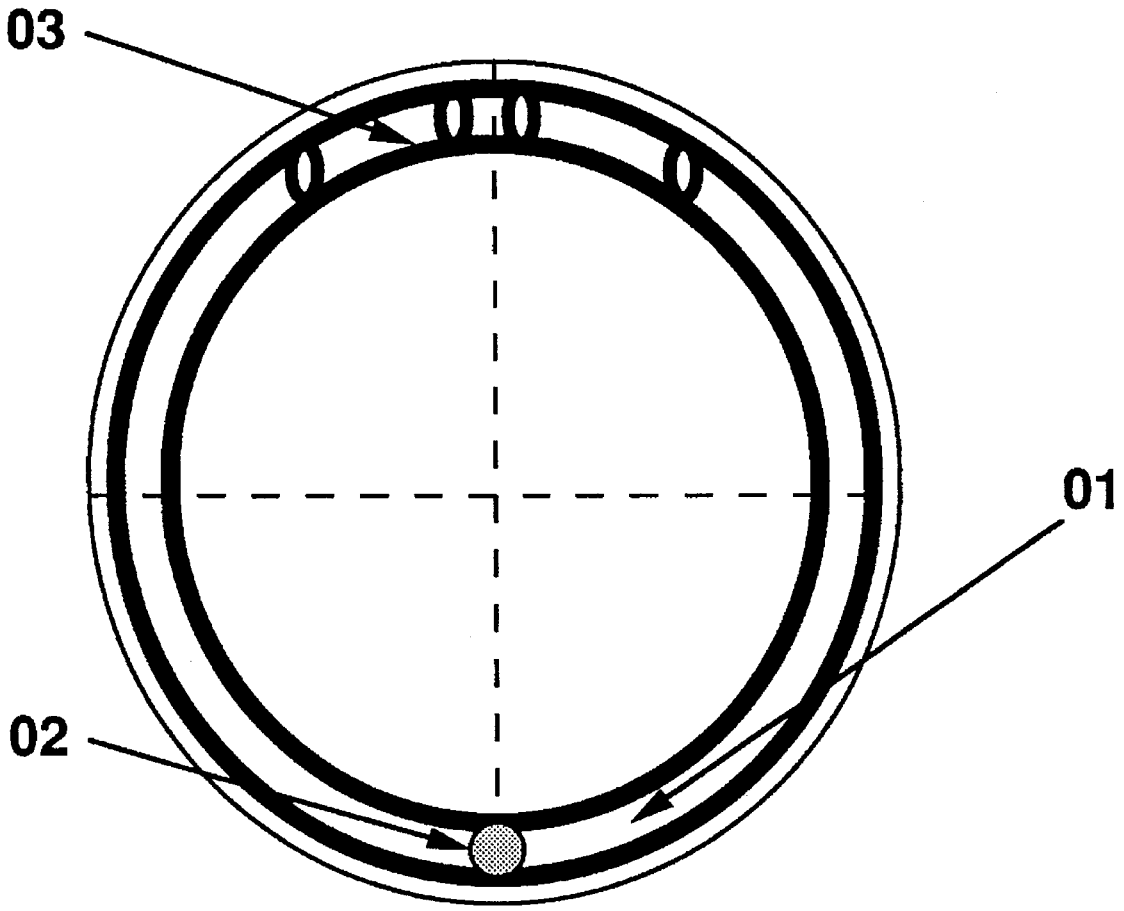
FIG. 1 is an exploded perspective view of a VERTICAL POSITION INDICATOR FOR OPTICAL SIGHTS incorporating the preferred embodiment of the present invention.

FIG. 1 shows the preferred embodiment of the invention, comprising a transparent tube formed into a toroid. Within the body of the toroid is an opaque spheroid, free to roll to a bottom dead center position under the action of the force of gravity. During sighting, the spheroid serves as a vertical position indicator, visible in the peripheral field of vision of the shooter. In the preferred embodiment, the toroid is fixed externally and co-axially to the shooter's side of the ocular lens of an optical sight, facilitating retrofit as an accesory to existing optical sights.

In the example shown, transparent flexible vinyl tubing with an inside diameter of ⅛" 01 is cut and bent to form a toroid with an outside diameter several thousandths of an inch greater than the inside diameter of a telescopic sight's external ocular lens housing. A vertical position indicator 02 consisting of a spherical metallic bearing 3/32" in diameter is secured within the toroid by insertion of two short lengths of grey-colored flexible vinyl tubing ⅛" in outside diameter 03 in the opposing ends of the toroid. The completed toroidal device is fixed externally and co-axially to the shooter's side of the ocular lens of a telescopic sight 04, and is secured by means of friction, a retaining ring or by use of a contact adhesive.

When this embodiment of the present invention is fixed externally and co-axially to the shooter's side of the ocular lens of a properly mounted telescopic sight, vertical position indicator 02 will fall to a true plumb position within the shooter's field of peripheral vision during sighting. By aligning the vertical axis of the scope's reticle to intersect indicator 02, zero roll about the longitudinal axis of the optical sight is positively assured, and substantially greater accuracy will result though the elimination of cant.

In all embodiments of the present invention, indicator 02 may be composed of any solid or liquid material free to fall to a true vertical position within the toroid.

The foregoing description of the preferred embodiment of the invention has been presented for the purposes of illustrating and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An optical sight for firearms, wherein the improvement comprises a roll-axis vertical position indicator, said indicator comprising a non-buoyant spheroid free to seek under the force of gravity a true vertical position; said indicator contained within a housing comprising a transparent, tubular toroid mounted coaxially and posterior of the ocular lens of the optical sight; said indicator free to move by rolling within said housing without the impediment of pivots, mechanical linkages, or any attached structure whatsoever.

* * * * *